United States Patent [19]

Gaudioso

[11] 4,271,248

[45] Jun. 2, 1981

[54] MAGNETIC LATENT IMAGE TONER MATERIAL AND PROCESS FOR ITS USE IN FLASH FUSING DEVELOPING

[75] Inventor: Stephen L. Gaudioso, Webster, N.Y.

[73] Assignee: Xerox Corporation, Stamford, Conn.

[21] Appl. No.: 115,973

[22] Filed: Jan. 28, 1980

[51] Int. Cl.[3] ..... G03G 11/00; G03G 13/20

[52] U.S. Cl. ..... 430/39; 430/107; 430/124; 430/126; 252/62.54; 252/62.56

[58] Field of Search ..... 430/39, 107, 126, 124; 252/62.54, 62.56; 528/192

[56] References Cited

U.S. PATENT DOCUMENTS

| | | | |
|---|---|---|---|
| 2,961,427 | 11/1960 | Walter | 528/192 |
| 3,590,000 | 6/1971 | Palermiti et al. | 430/108 |
| 3,601,091 | 8/1971 | Preckshot | 430/39 X |
| 3,627,682 | 12/1971 | Hall et al. | 252/62.54 |
| 3,632,667 | 1/1972 | Baum | 528/192 |
| 3,655,374 | 4/1972 | Palermiti | 430/124 X |
| 3,754,909 | 8/1973 | Feltzin et al. | 528/192 |
| 3,787,877 | 1/1974 | Nacci et al. | 346/74 MT |
| 4,031,021 | 6/1977 | Deming | 252/62.54 X |

*Primary Examiner*—John D. Welsh

*Attorney, Agent, or Firm*—H.M. Brownrout; P. H. Kordo; E. O. Palazzo

[57] ABSTRACT

A method for developing magnetic latent images comprising forming a latent image on a suitable substrate and contacting said image with a magnetic toner which comprises a magnetic material and a resin comprising a polymeric esterification product of a dicarboxylic acid and a diol comprising a diphenol is disclosed.

20 Claims, No Drawings

MAGNETIC LATENT IMAGE TONER MATERIAL AND PROCESS FOR ITS USE IN FLASH FUSING DEVELOPING

BACKGROUND OF THE INVENTION

This invention relates, in general, to magnetic imaging and, in particular, to improved magnetic toner material and a process for its use. More specifically, the present invention relates to new magnetic toners containing a polymeric esterification product of a dicarboxylic acid and a diol comprising a diphenol which are useful in magnetic imaging systems employing flash fusing.

There has been introduced a magnetic imaging system which employs a latent magnetic image in a magnetizable recording surface, which image may be used in the duplicating process, for example, by toning, either once or repetitively, transferring the developed image to a suitable substrate, such as paper, and fusing the image to said substrate.

The latent magnetic image may be provided by any suitable magnetization procedure. Typically, a magnetizable layer of marking material is arranged in imagewise configuration on a magnetic substrate. Well known electrostatographic methods are sometimes used to accomplish this. The latent image may then be developed and fused. There are a number of known methods for creating the latent image which are described, for example, in U.S. Pat. Nos. 4,032,923; 4,060,811; 4,074,276; 4,030,105; 4,035,810; 4,101,904 and 4,121,261. The teachings of each of these patents is being completely incorporated herein by reference.

In once such method, the magnetizable toner is developed in imagewise configuration onto an electrophotographic recording surface. The toner is then magnetized, for example, by an electronic recording head. The layer supporting the magnetized toner is then brought into contact with a magnetizable layer and the magnetized toner magnetizes the magnetizable layer in image configuration. A latent magnetic image is thus formed in the magnetizable layer corresponding to the imagewise arrangement of magnetized toner particles.

Concurrently with the growth of interest in magnetic imaging there has been increased interest in magnetic developers to render the latent magnetic images visible. In U.S. Pat. No. 3,221,315 there is described the use of encapsulated ferrofluids in a magnetic recording medium, wherein the ferrofluid orientation in the presence of a magentic field exhibits a variable light responsive characteristic. In this situation the magnetic recording medium is self-developing in the sense that magnetic marking material need not be employed to render a visible image. In other situations latent magnetic images are rendered visible by magnetic marking material. Thus, for example, in U.S. Pat. No. 3,627,682, there is disclosed binary toners for developing latent magnetic iamges, which binary toners include a particulate hard magnetic material and a particulate soft magnetic material in each toner particle. The toner particles include two materials in a binder material. In U.S. Pat. No. 2,826,634 there is described the use of iron or iron oxide particles either alone or encapsulated in low melting resin or binders for developing latent magnetic images.

Other patents evidencing the continuing interest in improved magnetic developers include U.S. Pat. No. 3,520,811, which discloses that magnetic particles of chromium dioxide appear to catalyze a surface polymerization or organic air drying film forming vehicles such as those employed in oil base materials in order that a coating of polymerized vehicle is formed around the particle; and U.S. Pat. No. 3,905,841 which teaches the prevention of agglomeration and the formation of homogeneous dispersions of cobalt-phosphorous particles into an organic resin binder by treatment with a solution containing sulfuric acid.

Typical fusing methods used in magnetic imaging that have been described in the prior art include, for example, heating the toner image to cause the resins thereof to at least partially melt and become adhered to the transfer medium followed by application of pressure to the toner, such as use of a heated roller. Solvent or solvent vapor fusing has also been used, wherein the resin component of the toner is partially dissolved.

In order to render magnetic imaging systems more amenable to higher speed duplicating machines, a non-contact flash fusing system, such as that well known in electrophotographic machines, should be used. Aside from higher process speed, improved reliability, especially for paper handling, and higher copy quality is attained. However, in general, toner materials which function satisfactorily with a hot-pressure roll fuser do not perform satisfactorily with a flash fuser. This is true because of the significantly different process-related rheological criteria between these two systems. For contact pressure roll fusing, one needs a toner with shear-dependent viscosity (i.e., low viscosity at high shear and relatively high viscosity at low shear) and sufficient viscoelasticity to avoid hot set-off to the fuser roll over the fusing temperature interval of interest. On the other hand, for non-contact flash fusing, one desires a toner with a strongly temperature-dependent viscosity and minimal elasticity such that the molten toner will rapidly flow and penetrate the paper fibers at the fusing temperature without benefit of contact induced shear. Specifically, for magnetic imaging systems, where the high pigment loading required for development can have an adverse effect on the desired fusing level of the toner, the toner materials designed for and found most acceptable in roll fusing do not have the desired rheological properties for flash fusing.

OBJECTS OF THE INVENTION

It is, therefore, an object of this invention to provide new toner materials and processes devoid of the above-noted disadvantages.

It is another object of this invention to provide new toner materials which are useful in magnetic imaging systems.

It is still another object of this invention to provide a single-component magnetic developer requiring no carrier.

It is a further object of this invention to provide new magnetic toner materials which may be used with high speed flash fusing systems.

It is still another further object of this invention to provide new magnetic toners containing high loadings of magnetite materials, which toners are useful in magnetographic systems, especialy magnetographic duplication systems.

It is yet another object of this invention to provide magnetographic duplication systems which incorporate flash fusing and has speed, reliability, copy quality and cost advantages relative to hot pressure roll fusing.

SUMMARY OF THE INVENTION

The foregoing objects and others are accomplished in accordance with this invention, generally speaking, by providing an improved magnetic toner material which is suitable for use in a magnetographic imaging process which incorporates flash fusing, said magnetic toner material comprising a pigment or colorant and a polymeric esterification product of a dicarboxylic acid and a diol comprising a diphenol. More specifically, the diphenol reactant has the general structure:

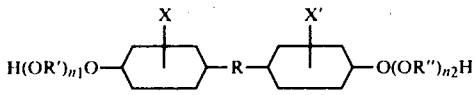

wherein R represents substituted and unsubstituted alkylene radicals having from 2 to 12 carbon atoms, alkylidene radicals having from 3 to 12 carbon atoms; R' and R'' represent substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R' and R'' represents an alkylene radical having from 3 to 4 atoms are preferred because greater blocking resistance, increased definition of characters and more complete transfer of toner images are achieved. Optimum results are obtained with diols in which R is a isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin posses greater resistance to film formation on reusable imaging surfaces and resist the formation of fines under machine operation conditions. Optimum results are obtained with alpha unsaturated dicarboxylic acids including fumaric acid, maleic acid or maleic acid anhydride because maximum resistance to physical degradation of the toner as well as rapid melting properties are achieved. It is believed that the presence of the unsaturated bonds in the alpha unsaturated dicarboxylic acid reactants provides the resin molecules with a greater degree of toughness without adversely affecting the fusing and comminution characteristics.

Diphenolic reactants corresponding to the formula set forth above are well known and may be prepared, for example, by reacting the alkali salts of an alkylidene or cycloalkylidene diphenol and the appropriate olefin chlorhydrin as disclosed, for example, in U.S. Pat. No. 2,331,265. Another well known method for preparing the diphenolic alcohols represented by the formula above consists of the direct addition of an alkylene oxide or arylene oxide to alkylidene or cycyloalkylidene diphenols. When mixtures of alcoholic and phenolic hydroxyl compounds are employed to form the diphenol, the alkylene oxides react preferentially with the phenolic hydroxyl groups. Therefore, when two or more moles of alkylene oxides are added to one mole of diphenol, both phenolic hydroxyl groups are substantially etherified, and the requirement in the formula set forth above that both $n_1$ and $n_2$ shall equal at least one is satisfied. However, slightly more than the stoichiometric amount of alkylene or arylene oxide is often added to produce a more flexible molecule. Where an excess of alkylene or arylene oxide is used, a random distribution of the oxyalkylene or oxyarylene groups between the two hydroxy ether groups occurs. Therefore, the oxyalkylene or oxyarylene groups per mole are designated generically by an average of $n_1+n_2$ oxyalkylene groups per mole. The sum of $n_1+n_2$ is preferably less than about 21 because the toner resin then possesses greater resistance to filming on imaging surfaces. Any suitable diphenol represented by the formula above may be employed. Typical diphenols having the foregoing general structure include: 2,2-bis(4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,1-bis(4-hydroxy-ethoxy-phenyl)-butane, 1,1-bis(4-hydroxy isopropoxy-phenyl) heptane, 2,2-bis(3-methyl-4-beta-hydroxy ethoxy-phenyl) propane, 1,1-bis(4-beta hydroxy ethoxy phenyl)-cyclohexane, 2,2'-bis(4-beta hydroxy phenyl)-norbornane, 2,2'-bis(4-beta hydroxy ethoxy phenyl) norbornane, 2,2-bis(4-beta hydroxystyryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxyl groups are oxyalkylated and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of imaged characters and more complete transfer of toner images are achieved. Optimum results are obtained with diols in which R is isopropylidene and R' and R'' are selected from the group consisting of propylene and butylene because the resins fromed from these diols possess higher agglomeration resistance and penetrate extremely rapidly into paper receiving sheets under fusing conditions.

Any suitable dicarboxylic acid may be reacted with the diols described above to form the toner resins of this invention. These acids may be substituted, unsubstituted, saturated or unsaturated. These acids have the general formula:

$$HOOCR'''_{n3}COOH$$

wherein R''' represents a substituted or unsubstituted alkylene radical having from 1 to 12 carbon atoms, arylene radicals or alkylene arylene radicals having from 10 to 12 carbon atoms and $n_3$ is less than 2. Throughout this specification and in the appended claims the expression dicarboxylic acid is intended to include anhydrides of such acids where such anhydrides exist. Typical dicarboxylic acids include: oxalic acid, malonic acid, succinic acid, glutaric acid, adipic acid, pimelic acid, suberic acid, azelaic aid, sebacic acid, phthalic acid, mesaconic acid, homophthalic acid, isophthalic acid, terrephthalic acid, o-phenyleneacetic-beta-propionic acid, itaconic acid, maleic acid, maleic acid anhydrides, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist the formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. Although it is not entirely clear, it is believed that the presence of the unsaturated bonds in the alpha unsaturated dicarboxylic acid reactants provides the resin molecules with a greater degree of toughness without adversely affecting the fusing and comminution characteristics.

Suitable esterification processes may be used to form the linear resins of this invention. These are discussed in U.S. Patent 3,590,000 and the full teachings of said patent are intended to be incorporated herein by reference.

Any suitable magnetic substance may be employed with the polymeric esterification product of the dicarboxylic acid and the diol comprising a diphenol. While about 40% to about 80% by weight of Mapico Black is preferred, with about 65% Mapico Black being optimum, other suitable materials such as metals including iron, cobalt, nickel, various magnetic oxides including $Fe_2O_3$, $Fe_3O_4$ and other magnetic oxides, certain ferrites such as zinc, cadmium, barium, manganese; chromium dioxide; various of the permalloys and other alloys such as cobalt-phosphorus, cobalt-nickel and the like; or mixtures of any of these may be used. Other magnetic materials are embraced within the present invention and it is not intended to be limited to those mentioned as illustrative examples. Also, any suitable pigment or colorant may be included in the toner. These may include, for example, carbon black, nigrosine dye, aniline blue, chalco blue, chrome yellow, ultramarine blue, methylene blue chloride, phthalocyanine blue and mixtures thereof.

The amount of magnetic pigment material ranges from about 40% to about 90% by weight and preferably from about 50% to about 75% in order to achieve adequate development and fusing at high speed, as for example with flash fusing. In such formulations the amount of resin used ranged from about 10% to about 60% by weight and preferably from about 25% to about 50% by weight.

Additional additives of various types may be added to or used in conjunction with the toners described herein in order to enhance process performance in one or more aspects. For instance, Silanox 101 (fumed silica), zinc stearate or other suitable powder flow agents may be used with the toners to aid development. Certain plasticizers, such as diphenylphthalate, are known to dramatically alter the melt viscosity of the toners and may be used to substantially reduce the energy required to fuse the toners to a substrate, such as paper. In addition, surface treatment or blending of the toners with magnetic and/or conductive additives, for example, certain metal powders, magnetites or carbon blacks, can be used to impart desirable process characteristics, particularly for development, to the toners of this invention.

The toners of the present invention may be prepared by various known methods such as spray drying. In the spray drying method the appropriate polymer is dissolved in an organic solvent like toluene or chloroform or suitable solvent mixture. The toner colorant and/or pigments are also added to the solvent. Vigorous agitation, such as that obtained by ball milling processes assists in assuring good dispersion of the colorant or pigment. The solution is then pumped through the atomizing nozzle while using an inert gas, such as nitrogen, as the atomizing agent. The solvent evaporates during atomization resulting in toner particles of a pigmented resin. Particle size of the resulting toner varies depending on the size of the nozzle. However, particles of a diameter between about 0.1 microns and about 100 microns generally are obtained. Melt blending or dispersion processes can also be used for preparing the toner compositions of the present invention. This involves melting a powdered form of an appropriate polymeric resin and mixing it with suitable colorants and/or pigments. The resin can be melted by heated rolls, which rolls can be used to stir and blend the resin. After thorough blending, the mixture is cooled and solidified. The solid mass that results is broken into small pieces and subsequently finely ground so as to form free flowing toner particles which range in size of from about 0.1 to about 100 microns. Other methods for preparing the toners of the present invention include dispersion polymerization, emulsion polymerization and melt blending/cryogenic grinding.

The toner of the present invention may be of any suitable size, although particles ranging in size from about 3 microns to about 20 microns and preferably from about 5 to about 12 microns fuse particularly well in magnetic imaging systems employing flash fusing. When the particles are too fine, poor development with high background may occur. Optimum results are attained with toner particles ranging in size from about 6 to about 9 microns.

Toner pile height, that is, the average nominal height of the unfused toner layer in the developed image areas of a magnetic image on an appropriate substrate, such as paper, can be an important parameter in influencing the degree or level of image fix (i.e., image permanence) attained for a given flash fusing input energy. For reasonable levels of fix at reasonable flash fusing energies, toner pile heights of from approximately 3 $\mu$m to about 30 $\mu$m can be employed, with pile heights from about 5 $\mu$m to about 20 $\mu$m preferred and pile heights from about 7 $\mu$m to about 15 $\mu$m optimum. In the latter regard, magnetic dipole development is particularly suited to the creation of flash fusible images, since the development forces can be controlled to produce extremely uniform toner layers of a given thickness across both line and solid area images.

DESCRIPTION OF PREFERRED EMBODIMENTS

The following examples further define, describe the magnetic toner compositions of the present invention and methods of utilizing them to develop latent magnetic images. Parts and percentages are by weight unless otherwise indicated.

EXAMPLE I

A toner consisting of 35 parts by weight of a propoxylated bisphenol fumarate resin, a polymeric condensation product of 2,2 bis (4-hydroxy-isopropoxy-phenyl)-propane and fumaric acid, having a melt index of approximately 10, and 65 parts by weight of the magnetite, Mapico Black, commercially available from the Columbian Chemicals Div. of Cities Service Company, is prepared by conventional milling and jetting techniques. The resulting black toner material has a volume average particle size of about 13.3 μm. This material is subsequently dry blended with about 0.4 percent by weight of a flow agent additive, Silanox 101, commercially available from Cabot Company to produce a free-flowing, magnetic developer.

This toner, when used in a magnetic imaging system for developing magnetic images, produced images of uniform, high optical density and excellent resolution. Excellent fixing of these images is obtained for flash fusing input energies from about 4.75 J/in$^2$ to about 6.5 J/in$^2$ from unfused toner pile heights from about 6 μm to about 12 μm, respectively.

EXAMPLE II

A toner is prepared in accordance with Example I, with the exception that the resulting black toner material has a volume average particle size of about 7.1 μm, and substantially similar results to those of Example I are obtained with this toner.

EXAMPLE III

The procedure of Example I is repeated with the exception that a propoxylated bisphenol fumarate resin having a melt index of approximately 14 is used (volume average particle size was about 6.35 μm), and substantially similar results are obtained when such a toner is used for developing a magnetic image.

EXAMPLE IV

The procedure of Example I is repeated with the exception that a propoxylated bisphenol fumarate resin having a melt index of approximately 18 is used (volume average particle size was about 8.5 μm), and substantially similar results were obtained when such a toner was used for developing a magnetic image.

EXAMPLE V

The procedure of Example IV is repeated with the exception that a toner consisting of 59 parts by weight of the propoxylated bisphenol fumarate resin, having a melt index of 18, and 41 parts by weight of the Mapico Black magnetite is prepared by conventional milling and jetting. The resulting toner has a volume average particle size of about 8.0 μm.

This toner, when used in a magnetic imaging system for developing magnetic images, produces images of uniform, high optical density and excellent resolution. Excellent fixing of these images is obtained for flash fusing input energies from about 4.0 N/in$^2$ to about 6.5 J/in$^2$.

EXAMPLE VI

A toner consisting of 35 parts by weight of a propoxylated bisphenol fumarate resin, having a melt index of approximately 10, and 65 parts by weight of the polyhedral magnetite, MO-7029, commercially available from the Pigments Division of Pfizer Corporation, is prepared by conventional spray drying techniques from chloroform solution. The resulting black toner material has a volume average particle size of about 12.5 μm. This material is subsequently dry blended with about 0.4 percent by weight of a flow additive, Silanox 101, commercially available from Cabot Company, to produce a free-flowing, magnetic developer.

This toner, when used in a magnetic imaging system, gives results substantially similar to those of Example I.

EXAMPLE VII

The procedure of Example V is repeated with the exception that the magnetic pigment used was the acicular magnetite, MO-4431, commercially avilable from the Pigments Division of Pfizer Corporation.

This toner (volume average particle size was about 13.7 μm), when used in a magnetic imaging system for developing magnetic images, produced images of uniform, high optical density and excellent resolution. Adequate fixing of these images is obtained for flash fusing input energies from about 6.0 J/in$^2$ to about 8.5 J/in$^2$.

EXAMPLE VIII

The procedure of Example I is repeated with the exception that a branched, propoxylated bisphenol fumarate resin, having a melt index substantially less than 10 was used.

This toner (volume average particle size was about 12.0 μm), when used in a magnetic imaging system for developing magnetic images, produces images of uniform, high optical density and excellent resolution. Adequate fixing of these images is obtained for flash fusing input energies from about 5.8 J/in$^2$ to about 8.5 J/in$^2$.

EXAMPLE IX–XII

The procedure of Example I is repeated four separate times using the following materials:

In Example IX—a polymeric condensation product of 2,2 bis (4-beta hydroxy ethoxy phenyl)-propane and fumaric acid;

In Example X—a polymeric condensation product of 2,2 bis (3-methyl-4-hydroxy ethoxy phenyl)-propane and maleic acid anhydride;

In Example XI—a polymeric condensation produce of 1,1-bis(4-beta-hydroxy ethoxy phenyl)cyclohexane and succinic acid; and In Example XII—a polymeric condensation product of 2,2 bis(4-hydroxy isopropoxy phenyl)propane and itaconic acid.

Each of the above toners, when used in a magnetic imaging system, produces images of uniform, high optical density and excellent resolution.

Although specific materials and conditions are set forth in the foregoing examples, these are merely intended as illustrations of the present invention. Various other suitable resins, magnetic substances, additives, pigments, colorants, and/or other components may be substituted for those in the examples with similar results. Other materials may also be added to the toner to sensitize, synergize or otherwise improve the fusing properties or other properties of the system.

Other modifications of the present invention will occur to those skilled in the art upon a reading of the present disclosure. These are intended to be included within the scope of this invention.

What is claimed is:

1. A method for developing magnetic latent images which comprises forming a magnetic latent image on a suitable substrate, contacting the image with a magnetic toner, transferring the image to a suitable substrate, followed by flash fusing the magnetic toner to said substrate, the toner particles having a pile height that ranges from about 3 microns to about 30 microns, the magnetic toner being comprised of a magnetic material and a resin comprising a polymeric esterification product of a dicarboxylic acid and a diol comprising a diphenol of the following formula:

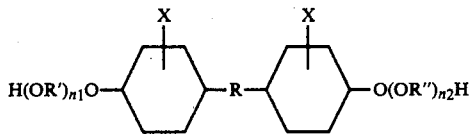

wherein R is selected from the group consisting of alkylene radicals having from 2 to 12 carbon atoms, alkylidene radicals having from 1 to 12 carbon atoms and cycloalkylidene radicals having from 3 to 12 carbon atoms; R' and R'' are selected from the group consisting of alkylene radicals having from 2 to 12 carbon atoms and alkylene arylene radicals having from 8 to 12 carbon atoms; X and X' are selected from the group consisting of hydrogen and alkyl radicals having from 1 to 4 carbon atoms; and $n_1$ and $n_2$ are each at least 1 and the average sum of $n_1$ and $n_2$ is less than 21.

2. A method according to claim 1 wherein said dicarboxylic acid is selected from the group consisting of acids having the general formula $$HOOCR'''_{n3}COOH$$

and anhydrides thereof wherein R''' is selected from the group consisting of alkylene radicals having from 1 to 12 carbon atoms, alkenylene radicals having from 1 to 12 carbon atoms, arylene radicals and alkylene arylene radicals having from 10 to 12 carbon atoms and $n_3$ is less than 2.

3. A method according to claim 1 wherein said polymeric esterification product is a condensation product of 2,2 bis (4-hydroxy-isopropoxyphenyl)-propane and fumaric acid.

4. A method according to claim 1 wherein said polymeric esterification product is a condensation product of 2,2 bis (4-hydroxyisopropoxy-phenyl)-propane and 2,2-dimethyl fumaric acid.

5. A method according to claim 1 wherein said polymeric esterification product is a condensation reaction product of 2,2 bis (4-hydroxybutoxy-phenyl)-propane and fumaric acid.

6. A method according to claim 1 wherein said polymeric esterification product is a condensation product of 2,2 bis (4-hydroxy-butoxyphenyl)-propane and 2,2-dimethyl fumaric acid.

7. A method according to claim 1 wherein said polymeric esterification product is a condensation product of 2,2 bis (4-hydroxy-ethoxy phenyl)-propane and fumaric acid.

8. A method according to claim 1 wherein said magnetic toner comprises between about 40% to about 90% by weight of said magnetic material and between about 10% to about 60% by weight of said resin.

9. A method according to claim 1 wherein said magnetic toner comprises between about 50% to about 75% by weight of said magnetic material and between about 25% to about 50% by weight of said resin.

10. A method according to claim 1 wherein said magnetic material is selected from the group consisting of magnetites, metals, metal oxides, ferrites or alloys.

11. A method according to claim 10 wherein said magnetite is Mapico Black.

12. A method according to claim 11 wherein said Mapico Black is present in an amount between about 40% and about 80% by weight.

13. A method according to claim 11 wherein about 65% by weight of Mapico Black is present.

14. A method according to claim 1 wherein said magnetic toner further contains a flow agent.

15. A method according to claim 14 wherein said flow agent comprises Silanox 101.

16. A method according to claim 1 wherein the toner particles range in size from about 3 microns to about 20 microns.

17. A method according to claim 16 wherein the toner particles range in size from about 5 microns to about 12 microns.

18. A method according to claim 17 wherein the toner particles range in size from about 6 microns to about 9 microns.

19. A method according to claim 1 wherein the toner pile height ranges from about 5 microns to about 20 microns.

20. A method according to claim 1 wherein the toner pile height ranges from about 7 microns to about 15 microns.

* * * * *